US006382599B1

(12) United States Patent
Aihara et al.

(10) Patent No.: US 6,382,599 B1
(45) Date of Patent: May 7, 2002

(54) CARBURETOR WITH ACCELERATOR

(75) Inventors: Tamio Aihara, Miyagi; Hiroki Ogasawara, Shibata-machi, both of (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/630,080

(22) Filed: Aug. 1, 2000

(30) Foreign Application Priority Data

Sep. 24, 1999 (JP) ..... 11-270747

(51) Int. Cl.[7] ..... F02M 9/08
(52) U.S. Cl. ..... 261/37; 261/44.8; 261/DIG. 39
(58) Field of Search ..... 261/35, 37, 34.2, 261/44.6, 44.8, 36.2, DIG. 39, DIG. 50, DIG. 68, DIG. 8

(56) References Cited

U.S. PATENT DOCUMENTS

| | | | | | |
|---|---|---|---|---|---|
| 3,843,755 | A | * | 10/1974 | Tuckey | 261/DIG. 68 |
| 4,271,096 | A | * | 6/1981 | Kobayashi | 261/44.8 |
| 4,335,061 | A | * | 6/1982 | Kobayashi | 261/44.8 |
| 4,481,152 | A | * | 11/1984 | Kobayashi et al. | 261/35 |
| 5,599,484 | A | * | 2/1997 | Tobinai | 261/35 X |
| 5,709,822 | A | * | 1/1998 | Togashi | 261/44.8 X |
| 5,711,901 | A | * | 1/1998 | Berg et al. | 261/37 X |
| 6,202,988 | B1 | * | 3/2001 | Abe et al. | 261/35 X |
| 6,217,008 | B1 | * | 4/2001 | Abe et al. | 261/35 X |

FOREIGN PATENT DOCUMENTS

| | | |
|---|---|---|
| EP | 0 705969 | 4/1996 |
| JP | 0-2037158 | 2/1990 |
| JP | 0 4399161 | 11/1992 |
| JP | 1 1125146 | 5/1999 |

* cited by examiner

*Primary Examiner*—Richard L. Chiesa
(74) *Attorney, Agent, or Firm*—Reising, Ethington, Barnes, Kisselle, Learman & McCulloc, P.C.

(57) ABSTRACT

A circuit for delivering fuel into a valve chamber of a rotary throttle valve type carburetor. The fuel delivery circuit includes a fuel supply nozzle, protruding into the valve chamber and fixed at the bottom of the valve chamber to the carburetor body, and an intermediate wall. The intermediate wall is connected to the bottom of the carburetor body. The intermediate wall has a first chamber defined therein, a second chamber defined therein, and structure which cooperatively defines a first passage and a second passage therein. The first passage communicates the first chamber to the fixed end of the fuel supply nozzle, and the second passage communicates the second chamber to the first chamber. In addition, the fuel delivery circuit also includes an enclosure having a pressurized fuel chamber disposed under the intermediate wall, wherein the intermediate wall cooperatively defines a third passage that communicates the pressurized fuel chamber to the second chamber. Furthermore, the fuel delivery circuit also includes a fuel jet, disposed along the first passage, and a check valve, disposed along the first passage between the fuel jet and the first chamber. In this way, the first passage, the first chamber, the second passage, the second chamber, and the third passage cooperatively define an elongated fuel passage between the pressurized fuel chamber and the fuel supply nozzle for delivering fuel into the valve chamber.

21 Claims, 2 Drawing Sheets

CARBURETOR WITH ACCELERATOR

REFERENCE TO RELATED APPLICATION

Applicants claim the priority of Japanese patent application, Ser. No. 11-270747, filed Sep. 24, 1999.

FIELD OF THE INVENTION

In the present invention relates to a rotary throttle valve type carburetor and accelerator system for an internal combustion engine mounted on a carrying work machine, such as a temporary sweeper, and more specifically, to a rotary throttle valve type carburetor having a fuel delivery circuit that controls the amount of fuel delivered to an engine during acceleration and/or high-speed operation of the engine.

BACKGROUND OF THE INVENTION

In a conventional rotary throttle valve type carburetor for an internal combustion engine as illustrated in FIG. 3, a check valve 53 and a fuel jet 7 are disposed along and mounted in a fuel passage 8*a* that connects a fuel supply nozzle 5 with a constant pressure fuel chamber 13. The fuel supply nozzle 5 is fixed at the bottom of a valve chamber 2 which is defined in a carburetor body 30. A rotary throttle valve 3 is movably fitted within the valve chamber 2 of the carburetor body 30. An intermediate wall 38 is connected to the bottom of the carburetor body 30, and a constant pressure fuel chamber 13 is disposed under the intermediate wall 38.

In the conventional rotary throttle valve type carburetor of FIG. 3, the length of the fuel passage 8*a* that connects the constant pressure fuel chamber 13 with the fuel supply nozzle 5 is short. As a result, the amount of fuel fed and delivered into the valve chamber 2 via the fuel passage 8*a* and the fuel supply nozzle 5 increases, in an undesirable geometric series manner, and becomes excessive as the number of revolutions per minute or speed of the engine increases. Such an excessive increase in the amount of fuel is represented by a solid curve 55 illustrated in FIG. 2. Although the amount of fuel fed from the constant pressure fuel chamber 13 is indeed adjusted by the fuel jet 7, the fed amount of fuel is still undesirably excessive upon full admission or opening of the rotary throttle valve 3.

Regarding the particular relationship between the number of revolutions per minute of the engine and the amount of fuel fed to the engine, a more desired and/or required characteristic of the relationship is that both (1) a necessary and proper amount of fuel be secured upon idling, and (2) the amount of fed fuel increases nearly linearly (such as in an arithmetic series) in proportion to the number of revolutions per minute of the engine, as represented by a dashed curve 54 illustrated in FIG. 2.

In light of the above, there is a present need in the art for a rotary throttle valve type carburetor which will enable an internal combustion engine to both (1) secure a necessary amount of fuel during low-speed operation (such as during idling) of the engine, and (2) have an improved fuel delivery characteristic during acceleration and/or high-speed operation of the engine.

SUMMARY OF THE INVENTION

The present invention provides a circuit for delivering fuel into a valve chamber defined in a carburetor body of a rotary throttle valve type carburetor for an engine. The fuel delivery circuit basically includes a fuel supply nozzle, protruding into the valve chamber and fixed at the bottom of the valve chamber to the carburetor body, and an intermediate wall. The intermediate wall is connected to the bottom of the carburetor body. The intermediate wall has a first chamber defined therein, a second chamber defined therein, and structure which cooperatively defines a first passage and a second passage therein. The first passage communicates the first chamber to the fixed end of the fuel supply nozzle, and the second passage communicates the second chamber to the first chamber. In addition, the fuel delivery circuit also basically includes an enclosure having a pressurized fuel chamber disposed under the intermediate wall, wherein the intermediate wall structure cooperatively defines a third passage that communicates the pressurized fuel chamber to the second chamber. Furthermore, the fuel delivery circuit also basically includes a fuel jet, disposed along the first passage, and a check valve, disposed along the first passage between the fuel jet and the first chamber. In this way, the first passage, the first chamber, the second passage, the second chamber, and the third passage cooperatively define an elongated fuel passage between the pressurized fuel chamber and the fuel supply nozzle for delivering fuel into the valve chamber.

According to the present invention, the elongated fuel passage defined in the fuel delivery circuit generally serves to increase the fluid resistance of the fuel delivery circuit as compared to other conventional fuel delivery circuits. During low-speed operation of the engine (such as during idling), since both the speed and level of fuel flow in the fuel delivery circuit are characteristically low, the fluid resistance through the fuel delivery circuit is therefore low as well. As a result, the increased fluid resistance attributable to the elongated fuel passage of the fuel delivery circuit is practically negligible during low-speed operation of the engine. Thus, in utilizing the fuel delivery circuit according to the present invention, a necessary amount of fuel is still successfully delivered to the engine during low-speed operation. On the other hand, during acceleration and/or high-speed operation of the engine, the amount of fuel delivered to the engine is sufficiently restricted by the elongated fuel passage such that the amount of fuel delivered to the engine increases in nearly linear proportion to the number of revolutions per minute of the engine. As a result, the delivery of an excessive amount of fuel to the engine during acceleration and/or high-speed operation of the engine is successfully avoided. Thus, in utilizing the fuel delivery circuit according to the present invention, a fuel supply characteristic which is better matched to the amount of fuel that the engine actually requires is successfully obtained.

In a preferred embodiment of the present invention, the fuel delivery circuit also includes a fuel pump and an inlet valve. The inlet valve is preferably situated between the fuel pump and the pressurized fuel chamber such that the inlet valve is able to provide fluid communication between the fuel pump and the pressurized fuel chamber. In addition, the inlet valve is also preferably situated proximate to the opening defined by the third passage in the enclosure of the pressurized fuel chamber. The pressurized fuel chamber, on the other hand, preferably has a substantially constant pressure and maintains a substantially constant level of fuel. In this way, a continuous supply of fuel, including fresh fuel unaffected by surrounding heat, is introduced into the third passage. As a result, smooth operation of the engine is ensured.

Also in a preferred embodiment of the present invention, the first chamber of the fuel delivery circuit is preferably situated under the fixed end of the fuel supply nozzle such that the first chamber structurally accommodates the check valve. In addition, the first chamber is also preferably situated such that the floor of the second chamber is higher than the floor of the first chamber. The elongated fuel passage, on the other hand, is preferably both substantially non-vertical and substantially non-linear. Furthermore, the elongated fuel passage, from the pressurized fuel chamber up to the fuel jet, preferably has a diameter which is larger than the inner diameter of the fuel jet.

In a highly preferred embodiment of the present invention, a fuel delivery circuit as described above is specifically incorporated in a rotary throttle valve type carburetor and accelerator system. Such a system includes a carburetor body, having a cylindrical valve chamber defined therein which crosses an intake passage defined therethrough, and a cylindrical rotary throttle valve, having a throttle bore. The cylindrical rotary throttle valve is fitted in the cylindrical valve chamber such that the throttle valve moves rotatively and slidably within the carburetor body. In addition, the system also includes a fuel supply nozzle, fixed at the bottom of the cylindrical valve chamber and protruding into the valve chamber to the throttle bore of the throttle valve, and a needle, supported by the throttle valve for insertion into the fuel supply nozzle. Furthermore, the system also includes an intermediate wall, connected to the bottom of the carburetor body, having a first chamber and a second chamber separately defined therein. An enclosure, having a pressurized fuel chamber, is disposed under the intermediate wall. A check valve and a fuel jet, also included within the system, are disposed in a first passage that communicates the first chamber to the fuel supply nozzle. A second passage included within the system communicates the second chamber to the first chamber, and a third passage within the system communicates the pressurized fuel chamber to the second chamber. In this way, the first passage, the first chamber, the second passage, the second chamber, and the third passage within the system all cooperatively define an elongated fuel passage between the pressurized fuel chamber and the fuel supply nozzle for delivering fuel into the valve chamber.

Objects, features, and advantages of the present invention include providing a fuel delivery circuit having an elongated fuel passage, wherein the elongated fuel passage sufficiently restricts the amount of fuel delivered to an engine during acceleration and/or high-speed operation, and also providing a fuel delivery circuit which is compact, rugged, durable, of relatively simple design, of economical manufacture and assembly, and which has a long, useful life in service.

BRIEF DESCRIPTION OF THE DRAWINGS

These and other objects, features, and advantages of the present invention will be apparent from the following detailed description of the preferred embodiment and best mode, appended claims, and accompanying drawings in which:

DETAILED DESCRIPTION OF THE PREFERRED EMBODIMENT

Structure of the Preferred Embodiment

Figure 1:
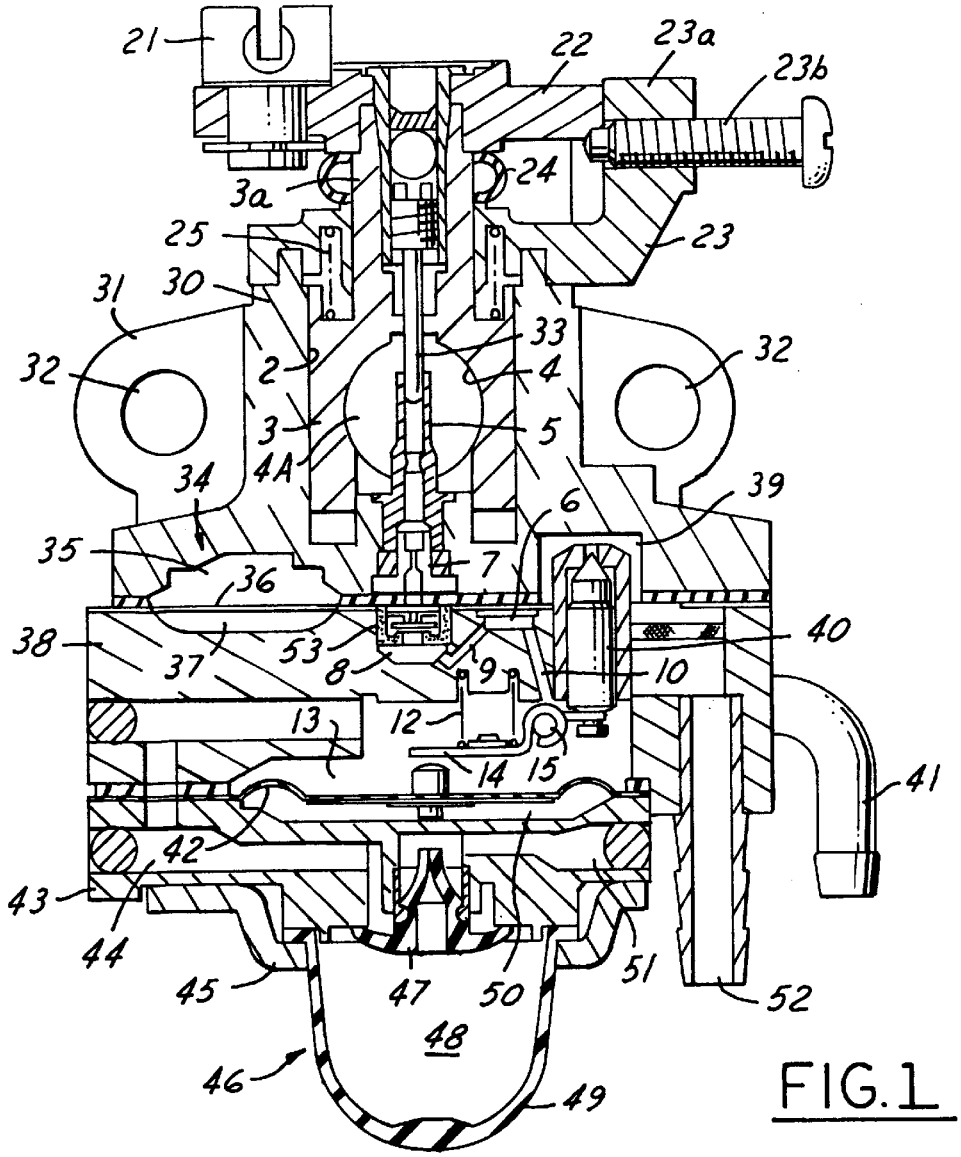
FIG. 1 is a front, cross-sectional view of a rotary throttle valve type carburetor incorporating a fuel delivery circuit according to the present invention.

FIG. 1 illustrates a rotary throttle valve type carburetor embodying the present invention with a carburetor body 30 having a cylindrical valve chamber 2 in which a rotary throttle valve 3 is slidably received to be rotated and moved up and down. The cylindrical valve chamber 2 perpendicularly crosses an intake passage 4A (a passage extending perpendicular to the plane of FIG. 1) that penetrates the carburetor body 30. An air cleaner (not shown) is connectable to an end of the carburetor body 30, and the other end of the carburetor body 30 is connectable to the air inlet of an engine (not shown) through a heat insulation pipe (not shown) by bolts insertable into a pair of left and right holes 32 defined in end flanges 31. During operation, air in the intake passage 4A is mixed with fuel fed from a fuel supply nozzle 5 in a throttle bore 4 and then supplied to a crank chamber (not shown) of a two-stroke engine through the heat insulation pipe.

A shaft 3*a*, on the upper end of the rotary throttle valve 3, passes through a cap (or lid) 23 that covers the valve chamber 2 so as to protrude outward. The upper end of the shaft 3*a* is connected to a throttle valve lever 22. A spring 25, surrounding the shaft 3*a*, is attached between the cap 23 and the rotary throttle valve 3. One end of the spring 25 is fixed to the rotary throttle valve 3, and the other end of the spring 25 is fixed to the cap 23. Due to the force of the spring 25, the rotary throttle valve 3 is rotatively energized to be in its idle position (that is, a position to close or throttle the intake passage 4A). A dust-proofboot 24 is attached between the cap 23 and the throttle valve lever 22. For metering fuel, a cam face, formed on a lower surface of the throttle valve lever 22, is biased against a cam follower (not shown) which protrudes upward from the cap 23 by the force of the spring 25. When the rotary throttle valve 3 is rotated in an accelerating direction against the bias of the spring 25, the open area ratio of the throttle bore 4 with respect to the intake passage 4A is increased. At the same time, a needle 33, that is supported by the shaft 3*a* of the rotary throttle valve 3 and inserted into the fuel supply nozzle 5, rises due to the cam mechanism. As a result, the open area ratio of the fuel injection hole of the fuel supply nozzle 5 increases.

The cap 23 is fixed to the carburetor body 30 by a plurality of bolts (not shown). An idling-adjusting screw 23*b*, that abuts the throttle valve lever 22 for adjusting the idling position, is fixed in a wall 23*a* that protrudes upward from the cap 23. An outer tube of a remote control cable (not shown) is fixable to the wall 23*a*, and an inner wire inserted into the outer tube is connectable to the throttle valve lever 22 through a swivel 21. In this way, an operator who operates a work machine-mounted engine having the carburetor of FIG. 1 can thereby operate the throttle valve lever 22 by remote control.

The fuel supply nozzle 5 is fixed at the bottom of the valve chamber 2 of the carburetor body 30 and communicates with an enclosed, pressurized fuel chamber 13 (that is, a metering chamber), having a substantially constant pressure, which is associated with a constant pressure fuel supply mechanism as explained hereinbelow. A diaphragm 36 of a fuel pump 34 is arranged between the carburetor body 30 and an intermediate wall 38. A chamber 35, for introducing fluid under a pulsating pressure, and a pump chamber 37 are partitively disposed over and under the diaphragm 36, respectively. The diaphragm 36 functions as an admission and delivery valve, moving up and down in accordance with the pulsating pressure of a crank chamber of the engine, sucking in fuel from a fuel tank (not shown) through a fuel pipe 52 to the pump chamber 37 of the fuel pump 34, and supplying the fuel to the constant pressure fuel chamber 13 through a chamber 39 and an inlet valve 40.

In the above-described constant pressure fuel supply mechanism, a diaphragm 42 is arranged between the intermediate wall 38 and another intermediate wall 43. The constant pressure fuel chamber 13 and an air chamber 50 are partitively disposed over and under the diaphragm 42, respectively. During operation, when the amount of fuel in the constant pressure fuel chamber 13 decreases and the diaphragm 42 is moved due to a negative pressure in the intake passage 4A, the inlet valve 40 is opened against the force of a spring 12 by a lever 14 that operates together with the diaphragm 42 and is fixed to the intermediate wall 38 by a support shaft 15. In this way, the fuel is supplied from the fuel pump 34 to the constant pressure fuel chamber 13. As a result, the amount of fuel in the constant pressure fuel chamber 13 is kept at about a constant level or volume and pressure.

A manually actuated primer or suction pump 46 has a flexible bulb 49 attached to the back of the intermediate wall 43 by bolts (not shown) through a retaining plate 45. In the bulb 49, there is provided a pump chamber 48, in which a mushroom-shaped composite valve 47 functioning as admission and delivery valves is attached. Before the engine starts for operation, the bulb 49 is repetitively manually pressed and released to suck the fuel vapor and air into the pump chamber 48 around a flexible lip portion of the composite valve 47. Then, the fuel vapor and air are transferred back to the fuel tank through a central shank and duckbill valve part of the composite valve 47, a passage 51, and an exhaust pipe 41. At this time, since the constant pressure fuel chamber 13 is under a negative pressure, the fuel in the fuel tank is supplied to the constant pressure fuel chamber 13 through the pump chamber 37, the chamber 39, and the inlet valve 40.

Figure 3:
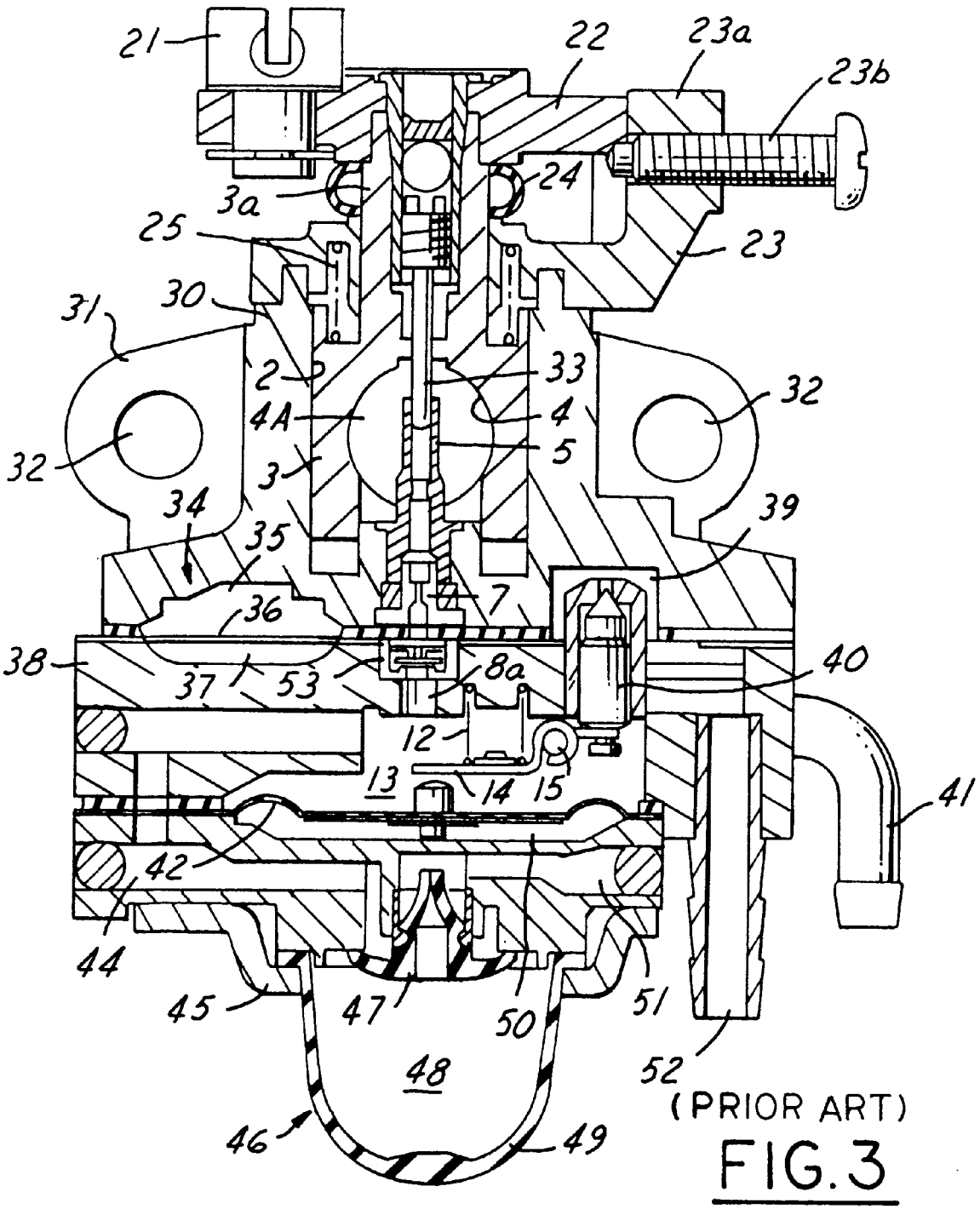
(PRIOR ART) FIG. 3
FIG. 3 is a front, cross-sectional view of a rotary throttle valve type carburetor incorporating a conventional fuel delivery circuit according to the prior art.

In the present invention, in order to secure a necessary amount of fuel upon low-speed operation of the engine and to improve the characteristic of an amount of fuel upon high-speed operation of the engine, the constant pressure fuel chamber 13 is partitively disposed by the diaphragm 42 under the intermediate wall 38 that is connected to the bottom of the carburetor 30. A first chamber 8 and a second chamber 6 are provided and disposed in the intermediate wall 38. The constant pressure fuel chamber 13, in the vicinity of the inlet valve 40, communicates with the second chamber 6 via a third passage 10, and the second chamber 6 communicates with the first chamber 8 via a second passage 9. The first chamber 8 is situated under the fuel supply nozzle 5 and thereby communicates with the bottom of the fuel supply nozzle 5 and also structurally accommodates a check valve 53. In such a configuration in FIG. 1, the overall length of the fuel passage defined from the constant pressure fuel chamber 13 to the fuel supply nozzle 5, through the check valve 53 and a fuel jet 7, is elongated as compared to the fuel passage 8*a* in the conventional rotary throttle valve type carburetor of FIG. 3.

Operation of the Preferred Embodiment

Operation of the rotary throttle valve type carburetor and accelerator system, in accordance with the present invention, is set forth and explained as follows.

When the engine operates at a low speed, since the amount of fuel to be consumed is small and the flow speed of the fuel flowing in the fuel passage from the third passage 10 up to the fuel supply nozzle 5 is low, the fluid resistance in the fuel passage is therefore also relatively low. When the engine speed is accelerated, the throttle lever 22 is rotated in an accelerating direction, the open area ratio of the throttle bore 4 with respect to the intake passage 4A is increased, and at the same time, the needle 33 rises due to the cam mechanism. As a result, the open area ratio of the fuel injection hole of the fuel supply nozzle 5 increases. The fuel in the constant pressure fuel chamber 13 is then transferred to the throttle bore 4 through the third passage 10, the second chamber 6, the second passage 9, the first chamber 8, the check valve 53, the fuel jet 7, the fuel supply nozzle 5, and the fuel injection hole of the fuel supply nozzle 5. Consequently, smooth acceleration of the engine is obtained by the increase in the amount of fuel and air. When the engine reaches and operates at a high speed, since the amount of fuel to be consumed is increased and the flow speed of the fuel flowing in the fuel passage from the third passage 10 up to the fuel supply nozzle 5 becomes high, the fluid resistance in the fuel passage becomes higher as compared to the fluid resistance during low-speed operation.

Figure 2:
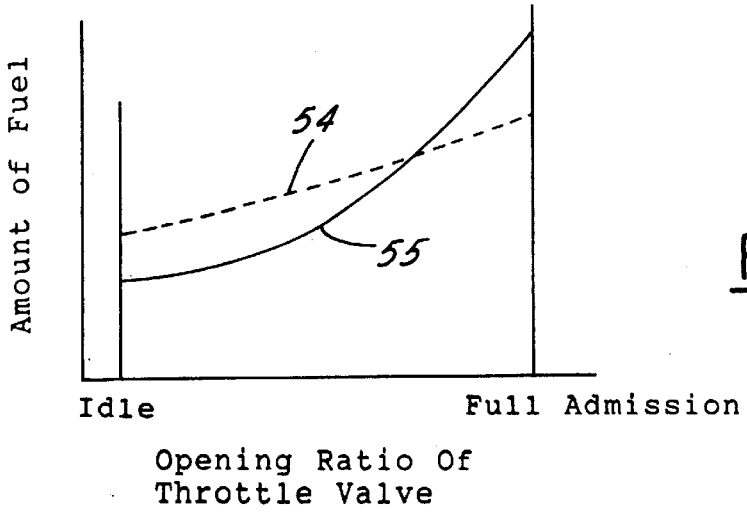
FIG. 2 is a graph illustrating and comparing the fuel supply characteristic of a rotary throttle valve type carburetor incorporating a fuel delivery circuit according to the present invention with the fuel supply characteristic of a rotary throttle valve type carburetor incorporating a conventional fuel delivery circuit.

Consequently, according to the present invention, regarding the characteristic of the amount of fuel with respect to the number of revolutions per minute of the engine, the rate of increase in the amount of fuel (that is, the gradient of the fuel supply characteristic curve illustrated in FIG. 2) upon high-speed operation is restricted by the making of the length of the above-mentioned fuel passage longer. That is, as demonstrated by a dashed curve 54 illustrated in FIG. 2, the amount of fuel under all conditions, ranging from the state of the rotary throttle valve 3 being essentially closed or throttled (during idle operation) to the state of the rotary throttle valve 3 being fully opened, is increased nearly linearly as a whole. As a result, the problem of feeding and delivering an excess amount of fuel when the rotary throttle valve 3 is fully opened is thereby eliminated. Thus, a fuel supply characteristic which is better suited to the amount of fuel that the engine actually requires is obtained, and the acceleration characteristics of the engine are also improved.

Furthermore, regarding the elongated fuel passage, the inner diameter of the fuel passage from the constant pressure fuel chamber 13 up to the fuel jet 7 is preferably larger than the inner diameter of the fuel jet 7 and is set up to be 1 millimeter or less with respect to a two-cycle engine of about 30 cc displacement.

In summary, although the length of the fuel passage is made longer from the constant pressure fuel chamber 13 up to the fuel supply nozzle 5 through the check valve 53 and the fuel jet 7, the required amount of fuel is still successfully secured upon low-speed operation of the engine due to the naturally low fluid resistance resulting from the characteristic low fuel flow rate during low-speed operation. On the other hand, during acceleration and/or high-speed operation of the engine, although fuel flow rate is characteristically higher, the amount of fuel delivered to the engine is sufficiently restricted by the increased fluid resistance created by the elongated fuel passage such that the amount of fuel delivered to the engine increases in a nearly linear proportion to the number of revolutions per minute of the engine. In this way, the delivery of an excessive amount of fuel to the engine during acceleration and/or high-speed operation of the engine is successfully avoided. As a result, an engine characteristic having a smaller rate of increase in the amount of fuel, as compared to a conventional engine characteristic, is successfully attained. In addition, since the third passage 10 communicating the constant pressure fuel chamber 13 to the second chamber 6 is opened to the constant pressure fuel chamber 13 in the vicinity of the inlet valve 40, fresh fuel that is not affected by surrounding heat is always introduced into the third passage 10, thereby enabling smooth operation of the engine with a continuous supply of fuel.

While the present invention has been described in what is presently considered to be the most practical and preferred embodiment and/or implementation, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structures as is permitted under the law.

We claim:

1. A rotary throttle valve/carburetor, with a body having a circuit for delivering fuel into a valve chamber, comprising:

a fuel supply nozzle protruding into the valve chamber and fixed at the bottom of said valve chamber to the carburetor body;

an intermediate wall, connected to the bottom of said carburetor body, having a first chamber defined therein, a second chamber defined therein, and structure cooperatively defining a first passage that communicates said first chamber to the fixed end of said fuel supply nozzle, and a second passage that communicates said second chamber to said first chamber;

an enclosure having a pressurized fuel chamber disposed under said intermediate wall, said intermediate wall cooperatively defining a third passage that communicates said pressurized fuel chamber to said second chamber;

a fuel jet disposed along said first passage; and a check valve disposed along said first passage between said fuel jet and said first chamber;

wherein said first passage, said first chamber, said second passage, said second chamber, and said third passage are constructed and arranged to cooperatively define an elongated fuel passage between said pressurized fuel chamber and said fuel supply nozzle for delivering fuel into said valve chamber.

2. The carburetor according to claim 1, wherein said pressurized fuel chamber has a substantially constant pressure and a substantially constant fuel level.

3. The carburetor according to claim 1, said carburetor also comprising:

a fuel pump; and an inlet valve situated between said fuel pump and said pressurized fuel chamber such that said inlet valve is able to provide fluid communication between said fuel pump and said fuel chamber.

4. The carburetor according to claim 3, wherein said inlet valve is situated proximate to the opening defined by said third passage in said enclosure of said pressurized fuel chamber.

5. The carburetor according to claim 1, wherein said first chamber structurally accommodates said check valve.

6. The carburetor according to claim 1, wherein said first chamber is situated under said fixed end of said fuel supply nozzle.

7. The carburetor according to claim 1, wherein the floor of said second chamber is situated higher than the floor of said first chamber.

8. The carburetor according to claim 1, wherein said elongated fuel passage is substantially non-linear.

9. The carburetor according to claim 1, wherein said elongated fuel passage is substantially non-vertical.

10. The carburetor according to claim 1, wherein said elongated fuel passage, from said pressurized fuel chamber up to said fuel jet, has a diameter which is larger than the inner diameter of said fuel jet.

11. A rotary throttle valve type carburetor comprising:

a carburetor body having a valve chamber defined therein;

a fuel supply nozzle protruding into said valve chamber and fixed at the bottom of said valve chamber to said carburetor body;

an intermediate wall, connected to the bottom of said carburetor body, having a first chamber defined therein, a second chamber defined therein, and structure cooperatively defining a first passage that communicates said first chamber to the fixed end of said fuel supply nozzle, and a second passage that communicates said second chamber to said first chamber;

an enclosure having a pressurized fuel chamber disposed under said intermediate wall, said intermediate wall cooperatively defining a third passage that communicates said pressurized fuel chamber to said second chamber;

a fuel jet disposed along said first passage; and a check valve disposed along said first passage between said fuel jet and said first chamber;

wherein said first passage, said first chamber, said second passage, said second chamber, and said third passage are constructed and arranged to cooperatively define an elongated fuel passage between said pressurized fuel chamber and said fuel supply nozzle for delivering fuel into said valve chamber.

12. The carburetor according to claim 11, wherein said pressurized fuel chamber has a substantially constant pressure and a substantially constant fuel level.

13. The carburetor according to claim 11, wherein said carburetor also comprises:

a fuel pump; and an inlet valve situated between said fuel pump and said pressurized fuel chamber such that said inlet valve is able to provide fluid communication between said fuel pump and said fuel chamber.

14. The carburetor according to claim 13, wherein said inlet valve is situated proximate to the opening defined by said third passage in said enclosure of said pressurized fuel chamber.

15. The carburetor according to claim 11, wherein said first chamber structurally accommodates said check valve.

16. The carburetor according to claim 11, wherein said first chamber is situated under said fixed end of said fuel supply nozzle.

17. The carburetor according to claim 11, wherein the floor of said second chamber is situated higher than the floor of said first chamber.

18. The carburetor according to claim 11, wherein said elongated fuel passage is substantially non-linear.

19. The carburetor according to claim 11, wherein said elongated fuel passage is substantially non-vertical.

20. The carburetor according to claim 11, wherein said elongated fuel passage, from said pressurized fuel chamber up to said fuel jet, has a diameter which is larger than the inner diameter of said fuel jet.

21. A rotary throttle valve/carburetor having a carburetor body with a circuit for delivering fuel into a valve chamber comprising:

a fuel supply nozzle protruding into the valve chamber and fixed at the bottom of said valve chamber to the carburetor body;

an intermediate wall, connected to the bottom of said carburetor body, having a first chamber and a second chamber defined therein;

a first passage providing fluid communication between said first chamber and the fixed end of said fuel supply nozzle;

a second passage providing fluid communication between said second chamber and said first chamber;

an enclosure having a pressurized fuel chamber disposed under said intermediate wall;

a third passage providing fluid communication between said pressurized fuel chamber and said second chamber;

a fuel jet disposed along said first passage; and a check valve disposed along said first passage between said fuel jet and said first chamber; and said first passage, said first chamber, said second passage, said second chamber, and said third passage are constructed and arranged cooperatively to define an elongated fuel passage between said pressurized fuel chamber and said fuel supply nozzle for delivering fuel into said valve chamber.

* * * * *

UNITED STATES PATENT AND TRADEMARK OFFICE

CERTIFICATE OF CORRECTION

PATENT NO. : 6,382,599 B1 
DATED : May 7, 2002
INVENTOR(S) : Tamio Aihara and Hiroki Ogasawara It is certified that error appears in the above-identified patent and that said Letters Patent is hereby corrected as shown below:

Column 7,
Line 17, delete "valve/carburetor" and insert -- value carburetor --.

Column 8,
Line 7, delete "type".
Line 65, delete "valve/carburetor" and insert -- valve carburetor --.

Signed and Sealed this

Ninth Day of July, 2002

*Attest:*

*Attesting Officer*

JAMES E. ROGAN
*Director of the United States Patent and Trademark Office*